US005600409A

United States Patent [19]

Dennie

[11] Patent Number: 5,600,409

[45] Date of Patent: Feb. 4, 1997

[54] OPTIMAL TONER CONCENTRATION SENSING SYSTEM FOR AN ELECTROPHOTOGRAPHIC PRINTER

[75] Inventor: Matthew M. Dennie, Rochester, N.Y.

[73] Assignee: Xerox Corporation, Stamford, Conn.

[21] Appl. No.: 603,298

[22] Filed: Feb. 20, 1996

[51] Int. Cl.[6] ..... G03G 21/00

[52] U.S. Cl. ..... 399/58; 399/72

[58] Field of Search ..... 355/203, 204, 355/208, 246; 430/30, 31, 102, 120

[56] References Cited

U.S. PATENT DOCUMENTS

| | | | |
|---|---|---|---|
| 3,799,668 | 3/1974 | McVeigh | 355/203 |
| 4,272,182 | 6/1981 | Abe et al. | 355/14 D |
| 4,318,610 | 3/1982 | Grace | 355/14 D |
| 4,419,010 | 12/1983 | Grombone et al. | 355/133 |
| 4,434,221 | 2/1984 | Oka | 430/122 |
| 4,492,179 | 1/1985 | Folkins et al. | 118/689 |
| 4,514,480 | 4/1985 | Wada et al. | 430/30 |
| 4,734,767 | 3/1988 | Koichi | 355/246 X |
| 4,786,924 | 11/1988 | Folkins | 355/3 DD |
| 4,829,336 | 5/1989 | Champion et al. | 355/246 |
| 4,879,577 | 11/1989 | Mabrouk et al. | 355/208 |
| 4,924,263 | 5/1990 | Bares | 355/203 |
| 5,034,775 | 7/1991 | Folkins | 355/259 |
| 5,150,135 | 9/1992 | Casey et al. | 346/159 |
| 5,210,572 | 5/1993 | MacDonald et al. | 355/208 |
| 5,214,476 | 5/1993 | Nomura et al. | 355/246 |
| 5,402,214 | 3/1995 | Henderson | 355/246 |

*Primary Examiner*—William J. Royer
*Assistant Examiner*—Quana Grainger
*Attorney, Agent, or Firm*—R. Hutter

[57] ABSTRACT

A maintenance method for a high-volume electrophotographic printer, in which an optimal toner/carrier (T/C) ratio for a primary toner supply is determined. The primary toner supply is first "stressed" to minimize the T/C therein, by developing a series of test patterns which include a series of narrow lines. Printing of narrow lines influences the proportion of relatively small toner particles in the toner supply. After this stressing, new toner particles are gradually introduced into the primary toner supply while a series of test patches is developed and the density of the test patches is monitored.

18 Claims, 2 Drawing Sheets

OPTIMAL TONER CONCENTRATION SENSING SYSTEM FOR AN ELECTROPHOTOGRAPHIC PRINTER

The present invention relates to a system for achieving an optimal concentration of toner within the developer mixture in an electrophotographic printer.

In the well-known process of electrophotographic printing, also known as xerography, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate, such as paper, and the image affixed thereto to form a permanent record of the image to be reproduced.

The step in the electrophotographic process in which the toner is applied to the latent image is known as "development." In any development system, a quantity of toner is brought generally into contact with the latent image, so that the toner particles will adhere or not adhere to various areas on the surface in conformity with the latent image. Many techniques for carrying out this development are known in the art. A number of such techniques require that the toner particles be evenly mixed with a quantity of "carrier." Generally speaking, toner plus carrier equals "developer." Typically, toner particles are extremely fine, and responsive to electric fields; carrier particles are relatively large and respond to magnetic fields. In a "magnetic brush" development system, the developer is exposed to relatively strong magnetic fields, causing the carrier particles to form brush-like strands, much in the manner of iron filings when exposed to a magnetic field. The toner particles, in turn, are triboelectrically adhered to the carrier particles in the strands. What is thus formed is a brush of magnetic particles with toner particles adhering to the strands of the brush. This brush can be brought in contact with the latent image, and under certain conditions the toner particles will separate from the carrier particles and adhere as necessary to the photoreceptor.

An important process parameter for any development system is the ratio of toner particles to carrier within the developer. It is also expectable that, in the course of use of the printer, the toner to carrier (T/C) ratio will change significantly as toner particles are transferred from the developer supply to the photoreceptor and ultimately to print sheets.

Electrophotographic printers of various types can also be used to create magnetic ink character recognition (MICR) images, which are familiar from negotiable instruments such as checks. MICR characters are printed with a material which itself includes magnetic properties, so that, when the characters printed with the MICR material are moved relative to a magnetic read head, each character will induce a unique electric signal in the read head.

With the electrostatic creation of MICR characters, a magnetically-permeable toner material is required. Thus, in a magnetic brush development system for printing MICR images, the toner particles are not only triboelectrically adhered to carrier particles, but have magnetic properties themselves, so that, when the toner particles are placed on a sheet to form an image, the printed characters will have magnetic properties. As a practical matter, in currently-available embodiments of electrostatic MICR printers, the magnetically-permeable toner material requires the addition of chemical additives, to ensure desirable flowing properties of the toner, which are typically not required in non-MICR toners. This relatively large amount of additives creates special practical problems unique to MICR printing. Further, the fact that MICR toners are typically used in printing alphanumeric characters influences the population of toner particles in a toner supply. When printing images in the form of alphanumeric characters or having general properties similar to alphanumeric characters (such as having only relatively small areas of contiguous black areas), the smaller particles in the population of all toner particles are favored to adhere to the photoreceptor, thus leaving a surplus of relatively large toner particles to remain in the toner supply. Thus, in a high-volume MICR printing apparatus where long print runs "stress" a particular supply of toner, maintenance of a suitable print quality, particularly in terms of image density, will tax the availability of smaller toner particles in the toner supply, and further influence the distribution of additives in the MICR toner. Therefore, when designing a print quality system, one must take into account the fact that MICR printing of alphanumeric characters creates certain distortions in the size distribution of toner particles in a toner supply.

In the prior art, U.S. Pat. No. 4,272,182 discloses a system for controlling image density by maintaining a fixed, predetermined image-developing bias voltage during development of a reference patch. This patent discloses a connection between a test patch photosensor and a toner supply apparatus.

U.S. Pat. No. 4,318,610 discloses a density-control apparatus wherein a first test area and a second test area are recorded on a photoreceptor, with the first test area being denser than the second test area. Concentration of toner particles within the developer is controlled in response to the detected density of the first test area, and the charge on the photoreceptor is regulated in response to the density of the second test area.

U.S. Pat. No. 4,419,010 discloses a method for controlling toner concentration by use of a patch sensor. The test patch is toned while the voltage on the charge-retentive surface is substantially zero, and while the developing field is provided by a voltage source having a polarity opposite that which is used during reproduction.

U.S. Pat. No. 4,434,221 discloses a toner concentration detection and control method in which part of a photoreceptor, in a non-image region thereof, is used as a "carrier adhering region." Magnetic carrier is caused to adhere to the carrier adhering region, while simultaneously current flowing between the developing electrode and the photoreceptor is measured, to control the replenishing amount of toner with respect to the developer.

U.S. Pat. No. 4,492,179 discloses a control system wherein, as toner particles are deposited on the latent image, the charge on the developer roller is sensed. In response to the sensed charge of the toner particles, additional marking particles are dispensed into the chamber of the housing.

U.S. Pat. No. 4,786,924 discloses a control system wherein the electrical current biasing a developer roll is measured to yield a control signal which controls the discharging of marking particles. Periodically this control signal is adjusted as a function of a detected image density of a test patch.

U.S. Pat. No. 4,514,480 discloses a toner concentration control system wherein the amount of magnetic carrier particles adhering to the photosensitive surface is measured, and then the toner in the developer supply is replenished according to the amount of carrier particles detected.

U.S. Pat. No. 4,829,336 discloses a toner concentration system particularly directed to testing multiple levels of toner coverage, such as "gray" and "black." The patent discloses manipulation of one "development vector" (potential difference in the photoreceptor) for optimizing gray development, while holding the development vector for black development constant. The patent discloses changing the initial charge voltage of the photoreceptor as a means of changing the development vector. In this patent the preferred method for correcting for a desired image density is to first change the concentration of toner within the developer station, and then to change the magnitude of the development field in order to adapt to the new toner concentration.

U.S. Pat. No. 4,879,577 discloses a system for controlling the electrostatic parameters of a development system, particularly as relating to a "saturation voltage" of the photoreceptor.

U.S. Pat. No. 5,034,775 discloses a control system in which the instantaneous triboelectric charge of the developer material is measured by integrating a measured current flow electrically biasing the donor roll from which toner particles are transferred to the photoreceptor.

U.S. Pat. No. 5,150,135 discloses an ionographic printing device in which, during deposition of marking particles on the latent image, the charge on the particles is sensed. In response to the sensed charge, additional toner particles are dispensed into the housing. Periodically, the actual concentration of toner particles within the developer is measured, and in response, the rate at which toner particles are replenished in the developer is modified to maintain an equilibrium concentration of toner within the developer.

U.S. Pat. No. 5,210,572 discloses a control system wherein densitometer readings of developed toner patches in a multi-color imaging apparatus are compared to target values stored in a memory and are compared to a previous densitometer reading. The densitometer readings are examined as to how far the reading is from a target value, and also as to the current trend of the actual measured density relative to the target. In this way, the rate of replenishment of the developer with toner is controlled.

U.S. Pat. No. 5,214,476 discloses a development system wherein the toner concentration is directly sensed by a magnetic sensor. The rate of introducing new toner into the developer housing is controlled in accordance with a fuzzy-logic inference based on the current output of the magnetic sensor and the change rate of the magnetic sensor.

U.S. Pat. No. 5,402,214 discloses a toner concentration sensing system in which toner from a secondary supply is introduced into a development unit when the measured density of a test patch is insufficient.

According to the present invention, there is provided a method of determining an optimal condition of toner particles in a primary toner supply, in an electrostatographic printing apparatus in which toner particles in a primary toner supply are applied to an electrostatic latent image on a charge receptor, and including a secondary toner supply and means for selectably adding toner particles from the secondary toner supply to the primary toner supply. Toner from the primary toner supply is applied to a series of electrostatic latent images without adding toner to the primary toner supply. A series of test patches of a predetermined development potential are created on the charge receptor and an actual density of each test patch after toner is applied thereto is measured, until an actual measured density on a test patch is within a first range of a predetermined toner density.

According to another aspect of the present invention, there is provided a method of determining an optimal condition of toner particles in a primary toner supply, in an electrostatographic printing apparatus in which toner particles in a primary toner supply are applied to an electrostatic latent image on a charge receptor, and including a secondary toner supply and means for selectably adding toner particles from the secondary toner supply to the primary toner supply. Toner from the primary toner supply is applied to a series of electrostatic latent images without adding toner to the primary toner supply. Each electrostatic latent image comprises a first stress pattern, the first stress pattern extending an entire width of the charge receptor in a direction perpendicular to the process direction and comprising a series of lines on the charge receptor, with each line in the stress pattern being no more than 0.68 mm in width. Toner from the primary toner supply is then applied to a series of electrostatic latent images while adding toner to the primary toner supply at a first rate, while periodically printing a series of test patches of a predetermined development potential on the charge receptor and measuring a resulting toner density of each test patch when toner is applied thereto, until a measured density on a test patch is within a first range of a predetermined toner density. Interleaved with the test patches is created a series of electrostatic latent images in a second stress pattern, the second stress pattern comprising a series of lines on the charge receptor, each line in the second stress pattern being no more than 0.68 mm in width. When a measured density on a test patch is within the first range of the predetermined toner density, toner from the primary toner supply is applied to a series of electrostatic latent images of the second stress pattern while adding toner to the primary toner supply at a second rate less than the first rate.

Figure 1:
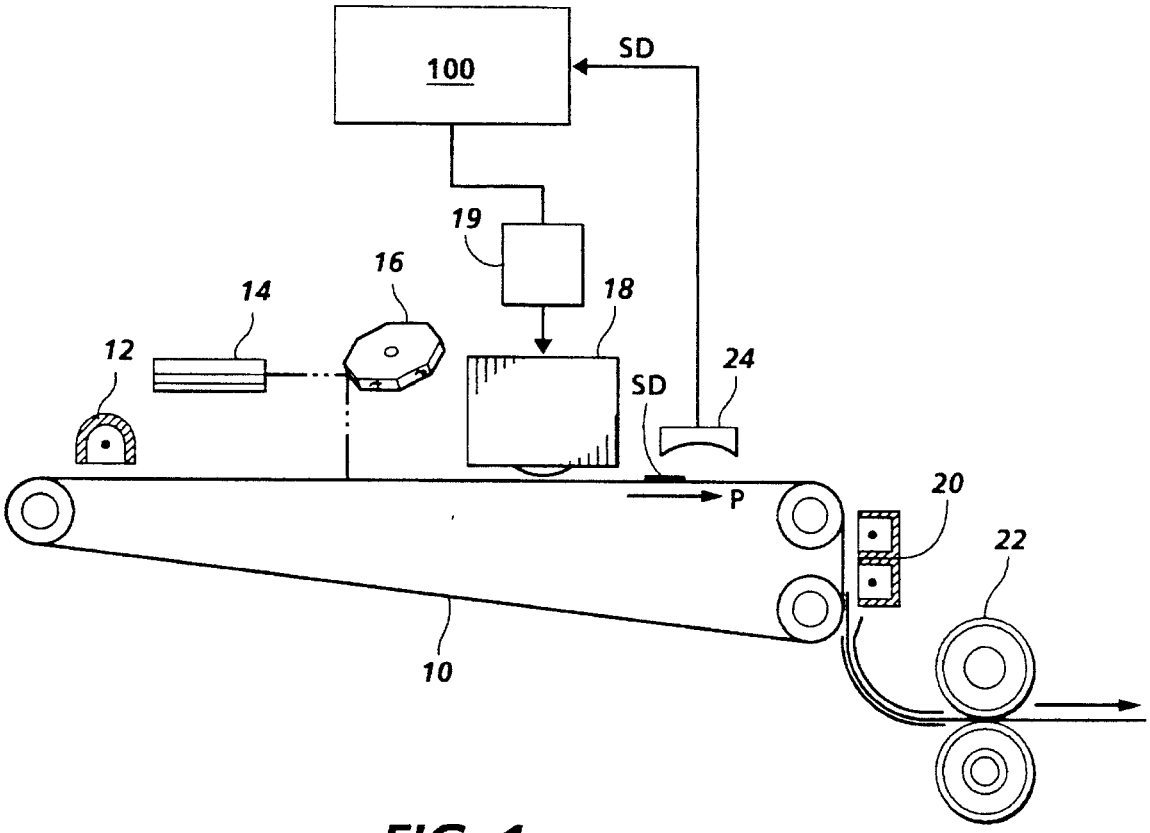
FIG. 1 PRIOR ART
FIG. 1 is a simplified elevational view of the basic elements of an electrophotographic printer.

FIG. 1 shows the basic elements of the well-known system by which an electrophotographic printer, such as a copier or a "laser printer," creates a dry-toner image on plain paper. There is provided in the printer a photoreceptor 10, which may be in the form of a belt or drum, and which comprises a charge-retentive surface. The photoreceptor 10 is here entrained on a set of rollers and caused to move through process direction P. Moving from left to right in FIG. 1, there is illustrated the basic series of steps by which an electrostatic latent image according to a desired image to be printed is created on the photoreceptor 10, how this latent image is subsequently developed with dry toner, and how the developed image is transferred to a sheet of plain paper.

The first step in the electrophotographic process is the general charging of the relevant photoreceptor surface. As seen at the far left of FIG. 1, this initial charging is performed by a charge source known as a "scorotron," indicated as 12. The scorotron 12 typically includes an ion-generating structure, such as a hot wire, to impart an electrostatic charge on the surface of the photoreceptor 10 moving past it. The charged portions of the photoreceptor 10 are then selectively discharged in a configuration corresponding to the desired image to be printed, by a raster output scanner or ROS, which generally comprises a laser source 14 and a rotatable mirror 16 which act together, in a manner known in the art, to discharge certain areas of the charged photoreceptor 10. Although the Figure shows a laser source to selectively discharge the charge-retentive surface, other apparatus that can be used for this purpose include an LED bar, or, in a copier, a light-lens system. The laser source 14 is modulated (turned on and off) in accordance with digital image data fed into it, and the rotating mirror 16 causes the modulated beam from laser source 14 to move in a fast-scan direction perpendicular to the process direction P of the photoreceptor 10.

After certain areas of the photoreceptor 10 are discharged by the laser source 14, the remaining charged areas are developed by a developer unit such as 18, causing a supply of dry toner to contact the surface of photoreceptor 10. The developed image is then advanced, by the motion of photoreceptor 10, to a transfer station including a transfer scorotron such as 20, which causes the toner adhering to the photoreceptor 10 to be electrically transferred to a print sheet, which is typically a sheet of plain paper, to form the image thereon. The sheet of plain paper, with the toner image thereon, is then passed through a fuser 22, which causes the toner to melt, or fuse, into the sheet of paper to create the permanent image. Some of the system elements of the printer shown in FIG. 1 are controlled by a control system 100, the operation of which will be described in detail below.

Whether the overall system uses single-component or magnetic-brush development, there will be retained in development unit 18 the primary supply of toner particles which development unit 18 draws upon to apply to an electrostatic latent image on photoreceptor 10. What is applied to the photoreceptor 10 is immediately taken out of the primary toner supply in development unit 18. With every print created by the apparatus, toner particles are drawn from the primary toner supply in development unit 18, which affects the ratio of toner to carrier (T/C) in magnetic-brush systems, and also influences the relative distribution of different sizes of toner particles in the primary toner supply.

It will be noted in FIG. 1 that, in addition to development unit 18, there is provided a secondary toner supply 19, which is configured to be able to add toner particles to primary toner supply 18. With a secondary toner supply 19, which may or may not contain extra carrier particles as well, the supply of toner is segregated from direct consumption by development unit 18. As shown in FIG. 1, control system 100 can control secondary toner supply 19 to discharge toner particles into the primary toner supply in development unit 18 through means known in the art, such as through a valve or door between the toner supplies.

As mentioned above, creation of images with only relatively small contiguous dark areas, such as alphanumeric characters, tend to favor drawing out smaller toner particles and leaving relatively larger toner particles to remain in the toner supply. There is typically an optimal distribution of particle sizes within the primary toner supply. While there are numerous prior-art systems which act to maintain a given electrophotographic printing apparatus at optimal conditions, such as retaining an optimal T/C, an object of the present invention is to provide a method by which the optimal amount of toner (which may be stated as T/C), as well as an optimal size distribution of toner particles, can be determined for the primary toner supply. Once this optimal condition (that is, the amount of toner particles, and size distribution) of the primary toner supply is determined, another system may operate to maintain the printing apparatus at this optimal condition. Typically, the method of the present invention is desirable whenever a major maintenance event occurs to the apparatus, such as replacement of the photoreceptor 10, refilling of the secondary toner supply 19, or replacement of all or a significant part of development unit 18.

The present invention is a method by which the toner concentration in the primary toner supply, such as in development unit 18, is first reduced to a point where there will be no detectable background development. Then, starting from this minimal T/C condition, the toner amount or T/C in the primary toner supply is gradually and deliberately increased, such as by introducing toner particles from a secondary toner supply, until a desired toner reflectance for a given type of test patch is obtained. By starting from a minimal possible T/C and gradually increasing the T/C upward, the optimal T/C (for a magnetic brush system) is determined for the particular apparatus under particular conditions.

Figure 2:
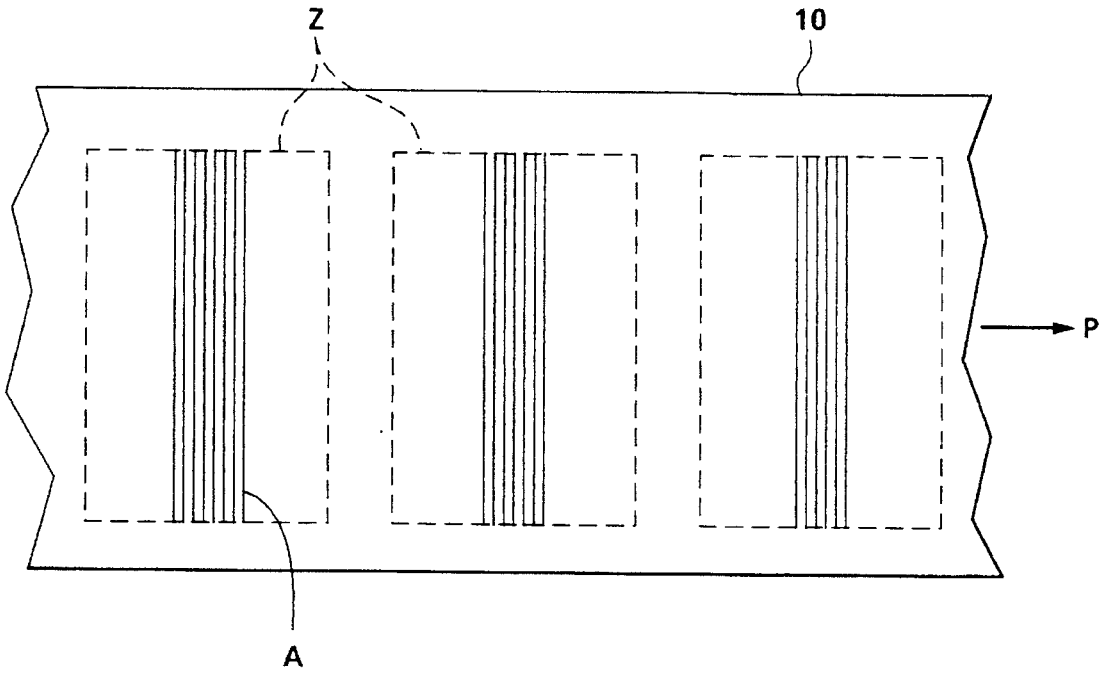
FIG. 2 is a plan view of a photoreceptor, showing an example of a stress pattern used in the method of the present invention.

Going into the method of the present invention in greater detail, the first "chapter" of the method involves deliberately reducing the T/C of the primary toner supply in development unit 18. FIG. 2 is a plan view of a portion of photoreceptor 10, with the process direction P indicated by the arrow. As part of the initial process of deliberately reducing the T/C of the primary toner supply in development unit 18, a series of "stress patterns," here indicated as A, are created, such as by laser source 14, and developed with the development unit 18. Each stress pattern A occupies about ¾ of the length along process direction P of each typical document zone Z. In a typical high-volume printing apparatus, each document zone Z corresponds to a single 8½"×14" sheet-size image.

Significantly, each stress pattern A consists of lines which are oriented perpendicular or parallel to process direction P, and extend across the width of the photoreceptor. The extension of the lines across the width of the photoreceptor 10 ensures a relatively equal stress of toner consumption across the width of, for example, a donor or developer roll (not shown) in the development unit 18. Further, the lines are of a particular fineness which has been selected both to significantly stress the development unit 18, and further to approximate the electrostatic behavior of images which are roughly the size of alphanumeric characters. The rapid on-and-off of the electrostatic behavior as the stress patterns move past the development unit 18 simulates the preferential draw of smaller toner particles, which is desired to simulate the behavior of the system when printing large numbers of alphanumeric characters. Whether the lines are oriented parallel or perpendicular to the process direction is relatively insignificant, but what is more important are the maximum width of each line, and the fact the pattern extends across the entire width of the photoreceptor (or at least the maximum width of each document zone Z, which is typically substantially the entire width of the photoreceptor).

A preferred test pattern consists of a series of lines, arranged perpendicular to process direction P, each line being two pixels in width and spaced from other lines by two pixels as well. In a 300 spot-per-inch resolution printer, this means that each line will be 1/150" in width and also spaced from neighboring lines by 1/150. Eight pixels in width and spacing is approximately the limit of width that has been found to work well, and four pixels in width and spacing is also suitable. In general, it is desirable that the lines be no more than eight pixels, or 8/300 inch (0.68 mm) in width and spacing.

Significantly, while the stress patterns shown in FIG. 2 are being created by the apparatus, secondary toner supply 19 is controlled so that no additional toner is added to the primarily toner supply in development unit 18. Thus, the primary toner supply in development unit 18 is being depleted of toner particles, and there is no replenishment from secondary toner supply 19. As mentioned above, the intention here is to minimize the final T/C of the primary toner supply in development unit 18, and to minimize the population of small particles therein. According to a preferred embodiment of the present invention, the equivalent of several hundred sheets, each corresponding to a document zone Z, are printed in this step, thereby reducing the T/C to a minimum practical level and removing the maximum amount of small particles.

The T/C of the primary toner supply is reduced, in the manner shown in FIG. 2, to a point at which there is high confidence that there is no "background development" of photoreceptor 10. Depending on whether a particular system is of a "charged-area development" or "discharged-area development" design, what is important is that the areas on the photoreceptor where there is no intention of being any toner in the finished image are not developed with toner to any detectable extent. Once the T/C of the primary toner supply has been reduced until there is reasonable confidence of no background development, a densitometer, such as shown as 24 in FIG. 1, is calibrated against a clean area of photoreceptor 10, establishing a zero point (meaning the presence of no toner) for the densitometer.

Figure 3:
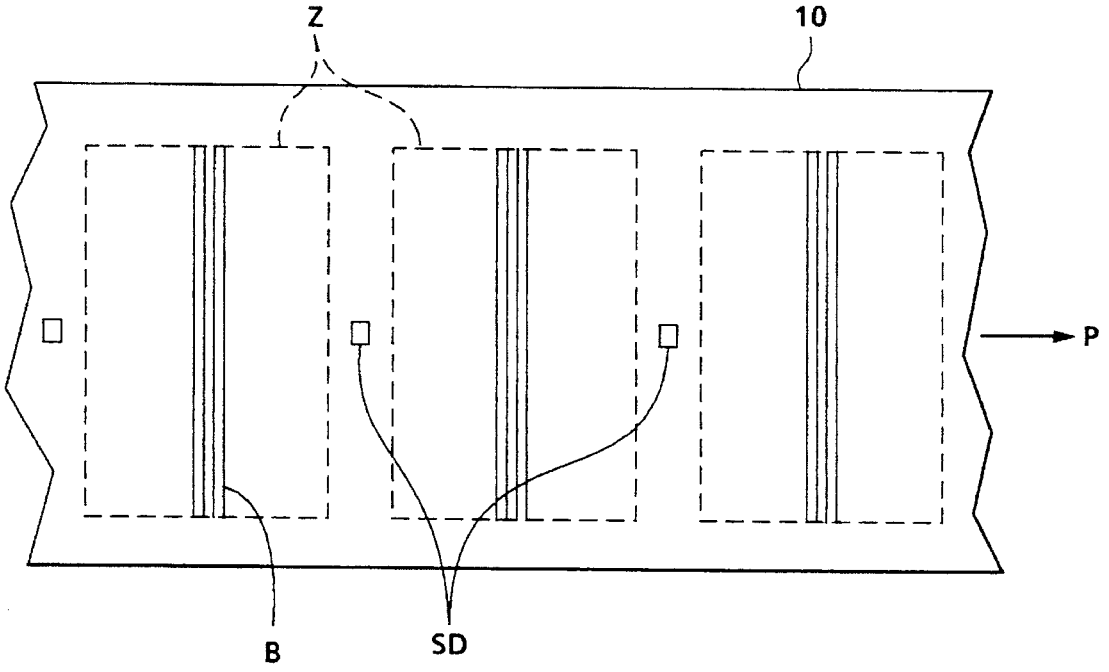
FIG. 3 is a plan view of a photoreceptor, showing an example of a second stress pattern which can be used with the method of the present invention.

In the second "chapter" of the method of the present invention, once the T/C of the primary toner supply has been minimized, the T/C is then deliberately increased, by introducing toner particles from a secondary toner supply 19 at a controlled rate. While toner particles are being added to the primary toner supply in development unit 18, the apparatus is run and caused to print out a series of second stress patterns, indicated as B, which are shown in FIG. 3. As shown in FIG. 3, the second stress patterns are similar to the stress patterns shown in FIG. 2, except that the lines occupy a smaller area than the first stress patterns, or in other words occupy a smaller proportion along the process direction of photoreceptor 10. While the stress patterns shown in FIG. 2 occupy approximately 6 inches of every 8½ inches of the photoreceptor 10 along process direction P, the second stress patterns shown in FIG. 3 occupy only two linear inches along process direction P for each document zone Z. Solid-area test patches, here shown as SD, are also created, preferably in the interdocument zones between neighboring document zones Z.

According to a preferred embodiment of the invention, each test patch is deliberately created to be a "low potential" solid area, which means that the surface area of the test patch SD is initially charged with slightly less potential than would be required for a full-black image. Development potential less than required for printing full black can be achieved by a preliminary routine which adjusts the potential level of the corotron 12 and the exposure level of laser 14 until a measured contrast potential between the background (white or exposed) areas and image (black or unexposed) areas of the latent images reaches a predetermined target. The bias potential applied to the developer rolls in the development unit 18 is then set to a predetermined offset from the measured background level and consequently from the image potential.

As the second stress patterns B are printed, new toner particles are introduced from secondary toner supply 19, and the series of solid area test patches SD are monitored. As the T/C of the primary toner supply is increased, it is to be expected that the resulting measured density of the test patches SD will increase.

In a typical embodiment of the method of the present invention, a desired extent of toner coverage for each test patch SD may be approximately 75%; with a minimized T/C after the first chapter of the method, the actual measured density may be only about 50%. As long as the actual measured density of the test patch is reasonably far (such as more than 10 percentage points) from the desired toner density, new toner particles can be introduced from secondary toner supply 19 into development unit 18 at a relatively high rate. However, once the measured toner density gets in the general range of the desired density, such as less than 10 percentage points, the rate of toner input from secondary toner supply 19 to development unit 18 should preferably be reduced from this relatively high rate to a range from 20% to 50% of the relatively high rate. The purpose of this slowing of introduction of toner particles is to allow the optimal T/C of the primary toner supply to be accurately reached from the low side, without risk of overshooting the optimal T/C. Thus, as the second stress patterns as shown in FIG. 3 continue to be output, the measured toner density of the test patches SD gradually approaches the desired test patch density.

At the point where the measured test patch density equals the desired test patch density, the optimal T/C for primary toner supply in development unit 18 is reached. Once the optimal T/C is reached, then the input of new toner particles from secondary toner supply 19 is stopped. After this point, the printing apparatus can be run to print documents, and other real-time control systems associated with the apparatus can be operated to maintain this desired T/C. Once again, the key purpose of the present invention is to determine the optimal T/C for a particular printer under particular circumstances; once this optimal T/C and particle size distribution is determined, other systems known in the art can operate to maintain these conditions.

The method of the present invention can be carried out automatically, such as through a software facility within control system 100, or can be performed to some extent manually by service personnel. If the electrophotographic printer is a light-lens copier, the stress patterns can be pre-printed on sheets which are exposed on the platen of the copier.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. In an electrostatographic printing apparatus in which toner particles in a primary toner supply are applied to an electrostatic latent image on a charge receptor, said apparatus further including a secondary toner supply and means for selectably adding toner particles from the secondary toner supply to the primary toner supply, a method of determining an optimal condition of toner particles in the primary toner supply, comprising the steps of:

applying toner from the primary toner supply to a series of electrostatic latent images without adding toner to the primary toner supply; and applying toner from the primary toner supply to a series of electrostatic latent images while adding toner to the primary toner supply at a first rate, while periodically creating a series of test patches of a predetermined development potential on the charge receptor and measuring an actual density of each test patch after toner is applied thereto, until an actual measured density on a test patch is within a first range of a predetermined toner density.

2. The method of claim 1, further comprising the step of applying toner from the primary toner supply to a series of electrostatic latent images while adding toner to the primary toner supply at a second rate less than said first rate, while periodically creating a series of test patches of a predetermined development potential on the charge receptor and measuring a resulting toner density of each test patch after toner is applied thereto, until an actual measured toner density on a test patch is within a second range of said predetermined toner coverage.

3. The method of claim 1, the step of applying toner from the primary toner supply to a series of electrostatic latent images without adding toner to the primary toner supply comprising the steps of moving the charge receptor in a process direction relative to the primary toner supply; and creating the each of the series of electrostatic latent images in a first stress pattern, the first stress pattern extending substantially an entire width of the charge receptor in a direction perpendicular to the process direction and comprising a set of lines on the charge receptor.

4. The method of claim 3, each line in the stress pattern being no more than 0.68 mm in width.

5. The method of claim 3, each line in the stress pattern being spaced no more than 0.68 mm from another line in the stress pattern.

6. The method of claim 3, the step of applying toner from the primary toner supply to a series of electrostatic latent images while adding toner to the primary toner supply at a first rate comprising the steps of moving the charge receptor in a process direction relative to the primary toner supply; and creating, interleaved with the test patches, a series of electrostatic latent images in a second stress pattern, the second stress pattern comprising a series of lines on the charge receptor.

7. The method of claim 6, each line in the second stress pattern being no more than 0.68 mm in width.

8. The method of claim 6, each line in the second stress pattern being spaced no more than 0.68 mm from another line in the second stress pattern.

9. The method of claim 6, wherein the second stress pattern covers an area on the charge receptor smaller than the first stress pattern.

10. The method of claim 6, wherein each of the first stress pattern and the second stress pattern extend an entire width of the charge receptor in a direction perpendicular to the process direction.

11. The method of claim 1, wherein the predetermined development potential is less potential than would be required for creating a full-black image.

12. The method of claim 1, wherein the primary toner supply includes MICR toner.

13. The method of claim 1, wherein the primary toner supply includes carrier particles.

14. The method of claim 1, further comprising the step of calibrating a density measuring apparatus immediately after the step of applying toner from the primary toner supply to a series of electrostatic latent images without adding toner to the primary toner supply.

15. In an electrostatographic printing apparatus in which toner particles in a primary toner supply are applied to an electrostatic latent image on a charge receptor, said apparatus further including a secondary toner supply and means for selectably adding toner particles from the secondary toner supply to the primary toner supply, a method of achieving an optimal condition of toner particles in the primary toner supply, comprising the steps of:

applying toner from the primary toner supply to a series of electrostatic latent images without adding toner to the primary toner supply, each electrostatic latent image comprising a first stress pattern, the first stress pattern extending substantially an entire width of the charge receptor in a direction perpendicular to the process direction and comprising a series of lines on the charge receptor, with each line in the stress pattern being no more than 0.68 mm in width;

applying toner from the primary toner supply to a series of electrostatic latent images while adding toner to the primary toner supply at a first rate, while periodically printing a series of test patches of a predetermined development potential on the charge receptor and measuring a resulting toner density of each test patch when toner is applied thereto, until a measured density on a test patch is within a first range of a predetermined toner density;

creating, interleaved with the test patches, a series of electrostatic latent images in a second stress pattern, the second stress pattern comprising a series of lines on the charge receptor, each line in the second stress pattern being no more than 0.68 mm in width; and when a measured density on a test patch is within the first range of the predetermined toner density, applying toner from the primary toner supply to a series of electrostatic latent images of the second stress pattern while adding toner to the primary toner supply at a second rate less than the first rate.

16. The method of claim 15, wherein the primary toner supply includes MICR toner.

17. The method of claim 15, further comprising the step of calibrating a density measuring apparatus immediately after the step of applying toner from the primary toner supply to a series of electrostatic latent images without adding toner to the primary toner supply.

18. The method of claim 15, wherein the predetermined development potential is less potential than would be required for creating a full-black image.

* * * * *